US008740018B2

(12) United States Patent
Chang

(10) Patent No.: US 8,740,018 B2
(45) Date of Patent: Jun. 3, 2014

(54) FEEDER WITH VARIABLE RHOMBOIDAL WALL

(76) Inventor: Hui-Pin Chang, Pingjhen (TW)

( * ) Notice: Subject to any disclaimer, the term of this patent is extended or adjusted under 35 U.S.C. 154(b) by 806 days.

(21) Appl. No.: 12/964,456

(22) Filed: Dec. 9, 2010

(65) Prior Publication Data

US 2012/0147695 A1 Jun. 14, 2012

(51) Int. Cl.
*G01F 11/20* (2006.01)

(52) U.S. Cl.
USPC ..... 222/201; 222/203; 222/232

(58) Field of Classification Search
USPC ..... 222/201, 203, 232; 366/154.1, 156.1, 366/186, 275
See application file for complete search history.

(56) References Cited

U.S. PATENT DOCUMENTS

| | | | | |
|---|---|---|---|---|
| 2,520,545 | A * | 8/1950 | Hughes | 222/199 |
| 2,633,133 | A * | 3/1953 | Higgins | 131/74 |
| 3,473,702 | A * | 10/1969 | Molitor | 222/203 |
| 5,215,228 | A * | 6/1993 | Andrews et al. | 222/203 |
| 5,381,967 | A * | 1/1995 | King | 239/659 |
| 6,889,874 | B2 * | 5/2005 | Vohwinkel | 222/198 |

* cited by examiner

*Primary Examiner* — David Sorkin
(74) *Attorney, Agent, or Firm* — Muncy, Geissler, Olds & Lowe, P.C.

(57) ABSTRACT

A feeder with variable rhomboidal walls includes a base housing, a soft hopper, a plurality of extrusion mechanisms, a pusher screw pole, a motor, and a decelerator. The extrusion mechanisms are respectively provided at four appropriate positions of the soft hopper, and are activated by protruding wheels with the aid of the motor in conjunction with the decelerator, so that the four extrusion mechanisms operate in pairs to squeeze the soft hopper while rendering a rhomboidal space change. Accordingly, a bridge effect associated with the prior art is eliminated to allow a raw material to fall and then to be dispensed by the pusher screw rod for further processing.

6 Claims, 12 Drawing Sheets

FEEDER WITH VARIABLE RHOMBOIDAL WALL

BACKGROUND OF THE INVENTION (a) Field of the Invention

The present invention relates a feeder with variable rhomboidal walls, and more particularly, to a feeder with variable rhomboidal walls applied for smoothly dispensing a raw material without incurring a bridge effect.

(b) Description of the Prior Art

A common feeder dispenses a raw material added to a barrel in a quantitative or random manner. Referring to FIG. 1, a conventional feeder comprises at least a barrel, a motor, a pusher rod, a soft hopper 100 placed below the barrel, a pair of swaying plates 200 squeezing the soft hopper 100 to extrude the raw material to be dispensed below by the push rob. Since the extrusion is completed by two objects namely the two swaying plates 200, with respect to one corresponding position, the raw material is likely to be heaped up to result in a bridge effect, i.e., the raw material from the hopper falls into intermittent piles with empty spaces in between, such that the raw material dispensed within unit time cannot stay quantitative. More specifically, in addition to the force applied to the swaying plates being relatively small, blind spots are also formed at the two sides of the soft hopper that extrude with respect to one corresponding position, the raw material at the blind spots may fail to fall below to frequently result in the bridge effect, which undesirably puts a halt to an overall production. Therefore, it is a vital task to provide a feeder that overcomes drawbacks associated with the prior art.

SUMMARY OF THE INVENTION

It is an objective of the invention to provide a feeder with a variable rhomboidal wall for eliminating the bridge effect associated with the prior art and hence smoothly feeding and dispensing a raw material.

To accomplish the objective of the invention, a feeder with variable rhomboidal walls according to an embodiment of the invention comprises a base housing, a soft hopper, a plurality of extrusion mechanisms, a pusher screw pole, a motor, and a decelerator. The extrusion mechanisms are respectively provided at four appropriate positions of the soft hopper, and are activated by protruding wheels with the aid of the motor in conjunction with the decelerator, so that the four extrusion mechanisms operate in pairs to squeeze the soft hopper while rendering a rhomboidal space change. Accordingly, a bridge effect associated with the prior art is eliminated to allow a raw material to fall and then to be dispensed by the pusher screw rod for further processing.

To enable a further understanding of the said objectives and the technological methods of the invention herein, the brief description of the drawings below is followed by the detailed description of the preferred embodiments.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention. In the drawings.

DETAILED DESCRIPTION OF THE PREFERRED EMBODIMENT

The following description is given with reference to FIGS. 2 to 12 disclosed. According to the present invention, a feeder with variable rhomboidal walls for smoothly feeding and dispensing a raw material without causing a bridge effect is provided.

Figure 1:
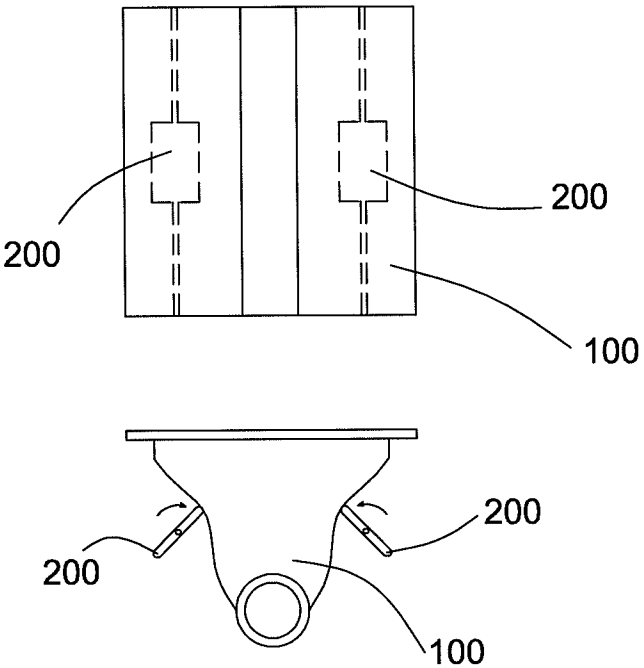
Prior Art FIG.1
FIG. 1 is a schematic diagram illustrating extrusion of swaying plates of a prior soft hopper.
Figure 2:
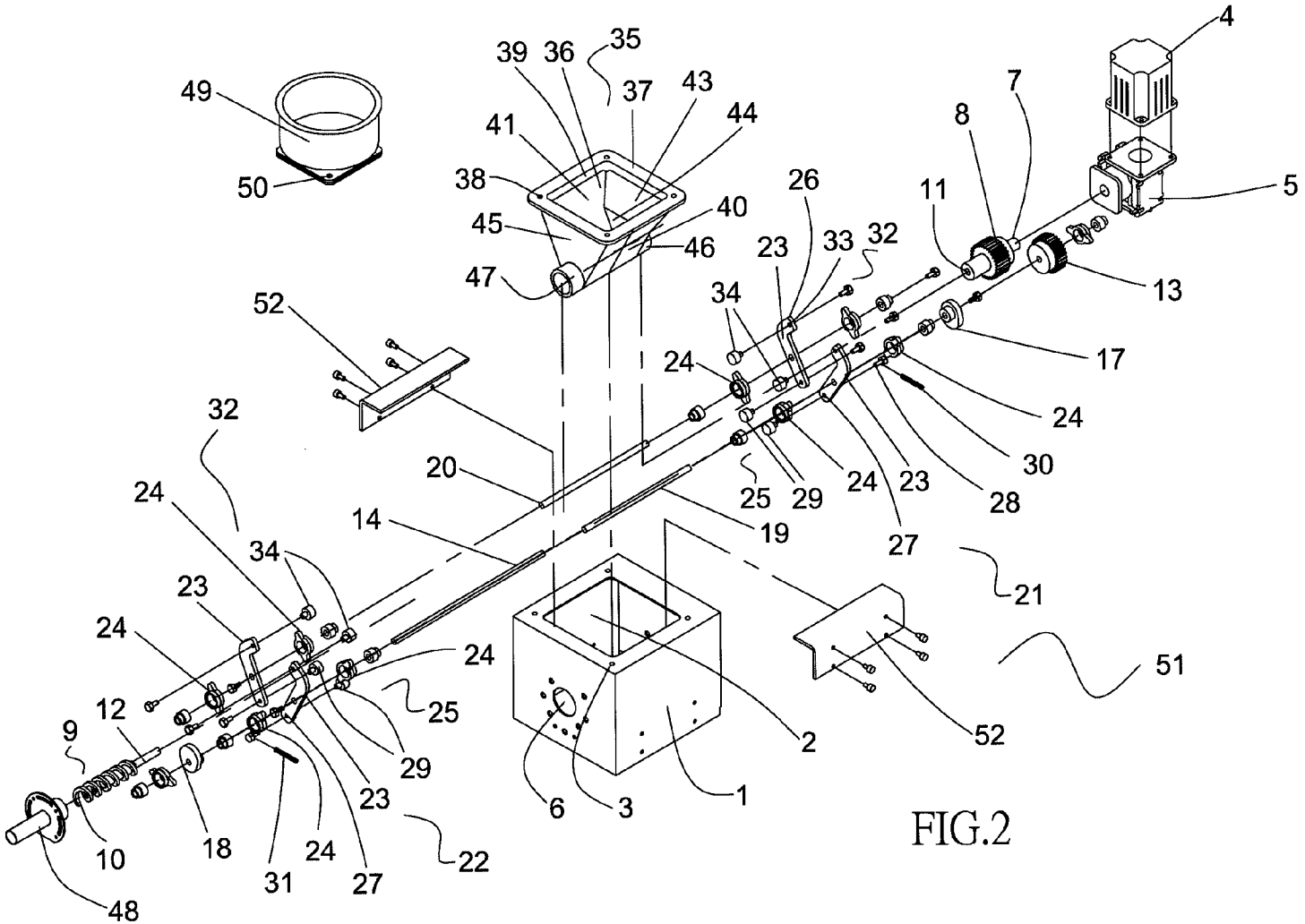
FIG. 2 is an exploded view of the present invention.
Figure 3:
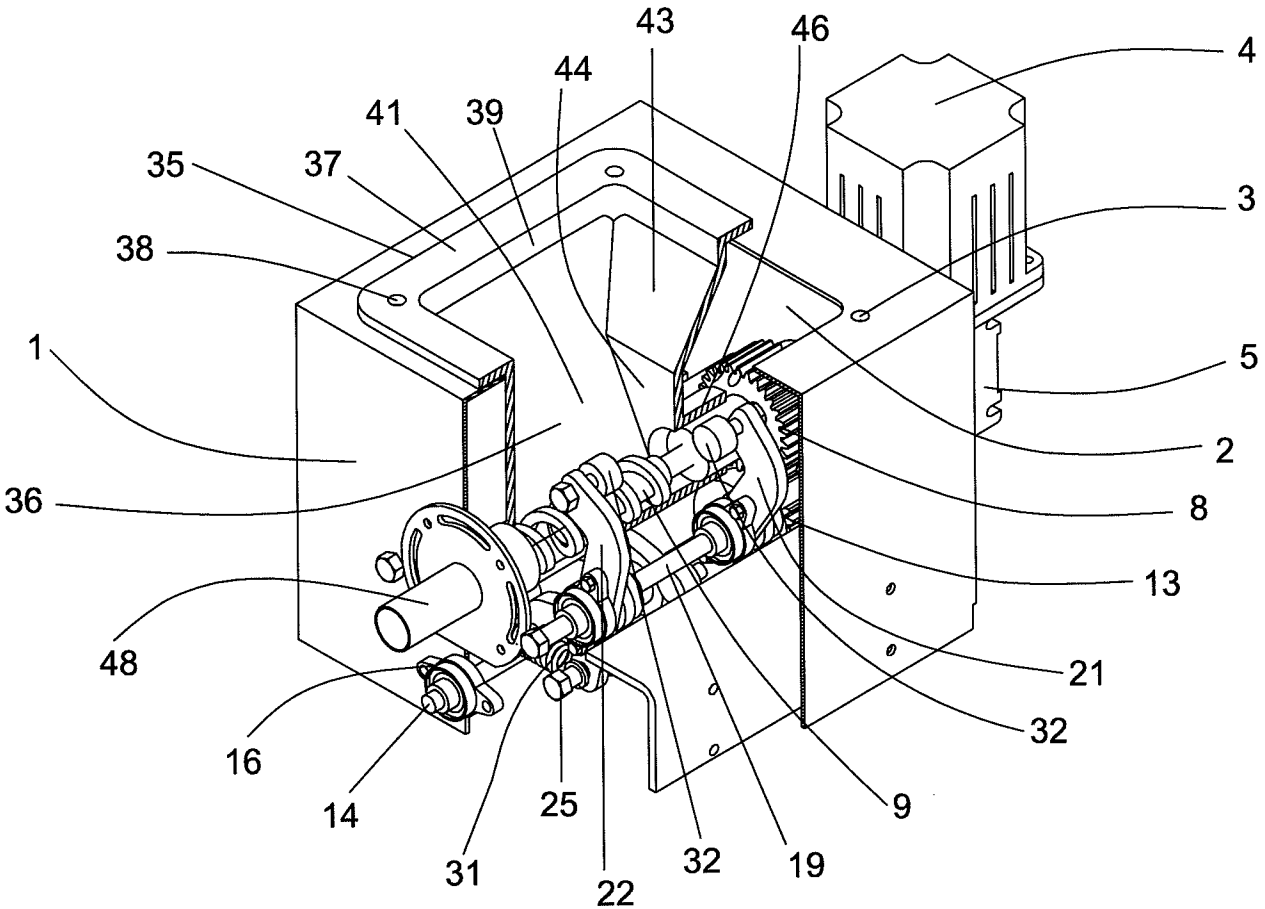
FIG. 3 is a partial sectional view of the present invention.
Figure 4:
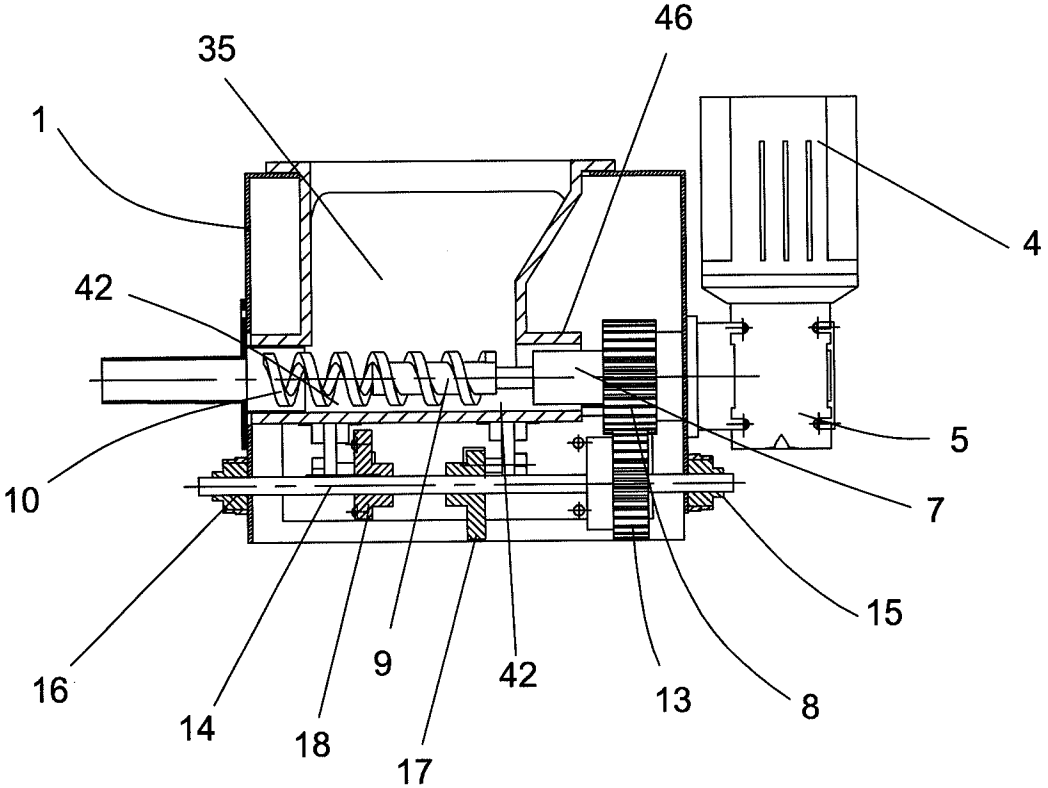
FIG. 4 is a perspective view of the present invention.
Figure 5:
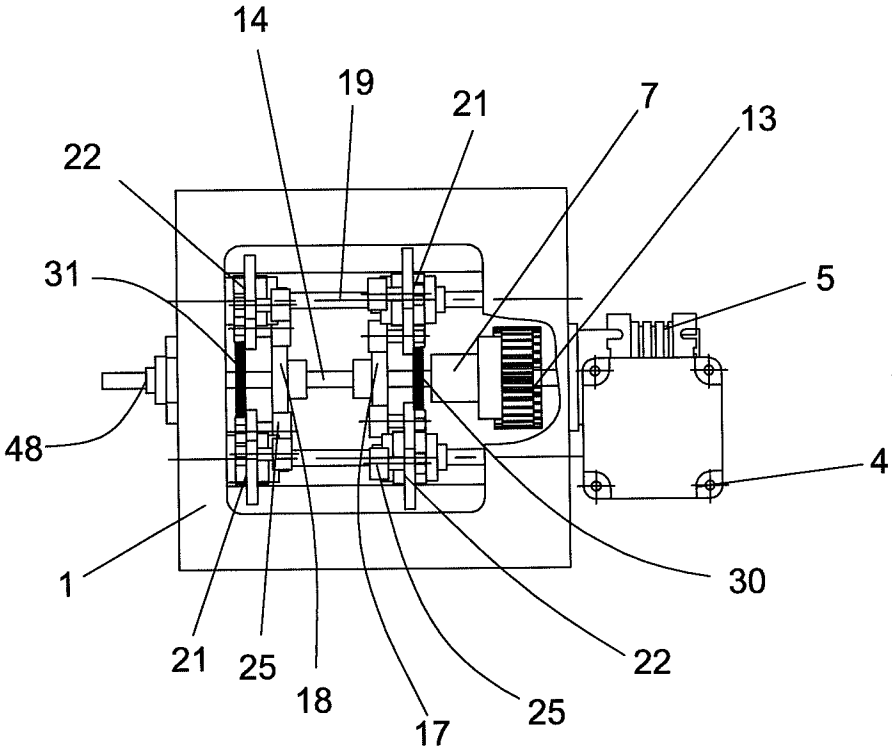
FIG. 5 is a schematic diagram of an extrusion mechanism of the present invention.
Figure 6:
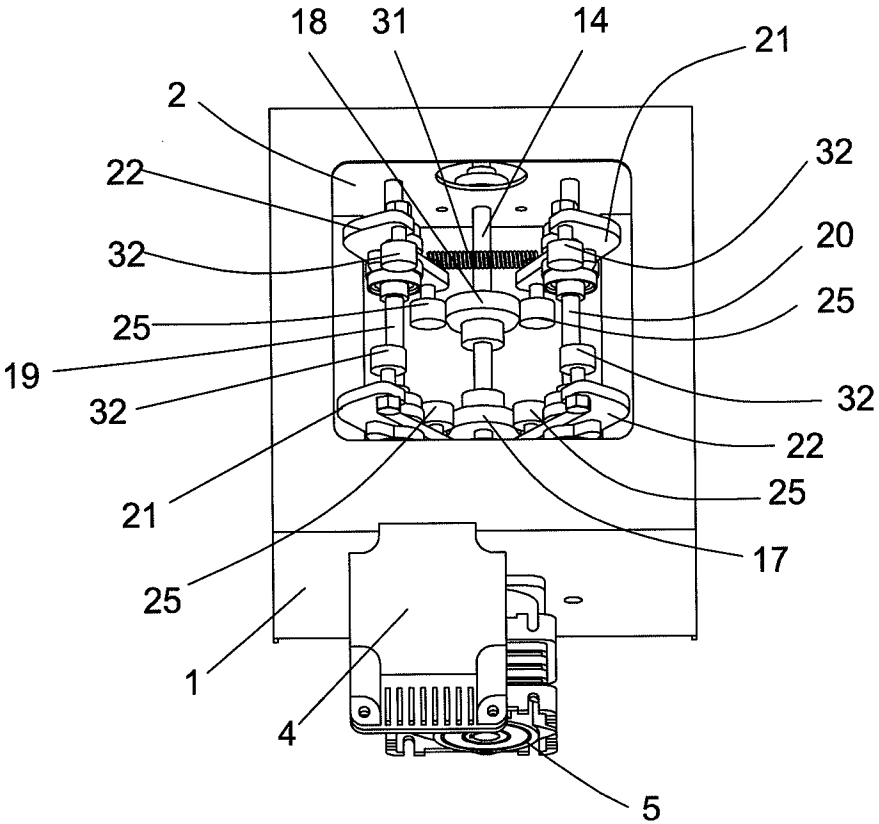
FIG. 6 is a schematic diagram illustrating configuration of idle pulleys and protruding wheels of the present invention.
Figure 12:
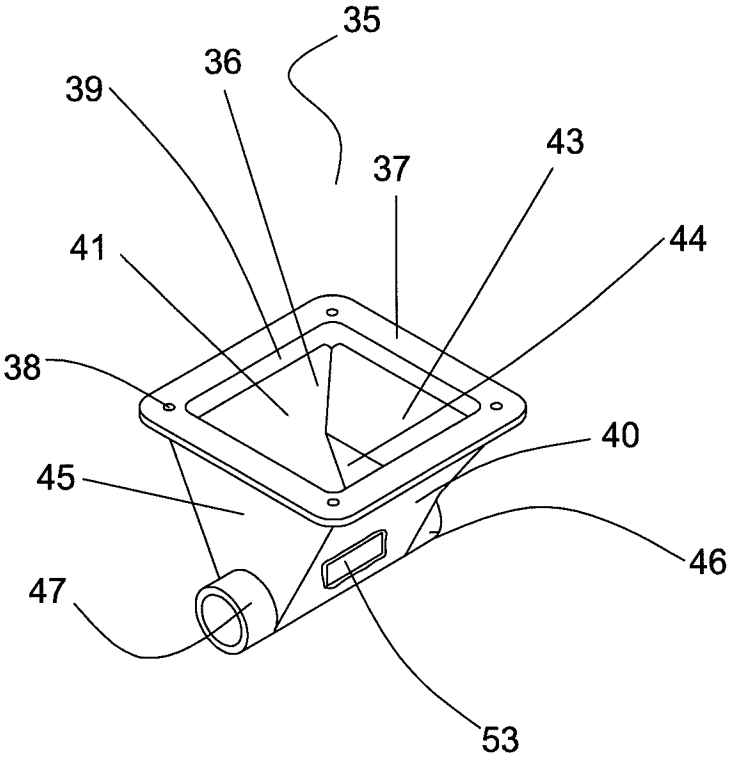
FIG. 12 is a schematic diagram of a soft hopper comprising long plates of the present invention.

With reference to FIGS. 2 to 4, a feeder with variable rhomboidal walls for smoothly feeding and dispensing a raw material without causing a bridge effect comprises a base housing 1, which has an opening 2 at an upper end thereof, an orifice 3 at a side thereof for communicating with a feeder barrel, and an orifice 6 at another side thereof. A motor 4 having an axial end is provided at one side of the base housing 1. A decelerator 5 is joined with the axial end of the motor 4, and has a power shaft 7 inserted into the base housing 1 through the orifice 6. The power shaft 7 is disposed with a gear 8, and has its frontend provided with a pusher screw pole 9. The pusher screw pole 9 is provided with an extendable screw 10, and is fixed in an indenture 11 of the power shaft 7. Further, the pusher screw pole 9 has a physical pin 12 at a locking end thereof, and is also partially enveloped by a screw 10, so as to yield a larger space for transporting the raw material without leaving residual raw material behind. For engaging with the gear 8, a side corresponding to the gear 8 is provided with a gear 13 fixedly located to a horizontal bar 14 of the base housing 1. The horizontal bar 14, flexibly disposed by two interrelated bearing brackets 15 and 16, is provided with a pair of front and rear protruding wheels 17 and 18 respectively having a range of 180° from a highest point to a lower point, with the range being defined by adjusting relative angles of the two protruding wheels 17 and 18. At two outer sides of the horizontal bar 14 are two supporting rods 19 and 20. A pair of extrusion mechanism 21 and 22 is respectively provided at appropriate front and rear positions of the supporting rods 19 and 20 corresponding to the protruding wheels 17 and 18. For illustrative purposes, one from the symmetrical extrusion mechanisms is taken as an example. With reference to FIGS. 2, 5, 6 and 7, each of the extrusion mechanisms 21 and 22 comprises at least an ear piece 23, a bearing bracket 24, and an idle pulley 25. The ear piece 23 is fixed to the supporting rod 19 via the bearing bracket, and is capable of one-axial movements. According to the embodiment of the invention, the left and right ear pieces 23 are fastened and then fixed to the supporting rod 19. Alternatively, each of the ear pieces 23 is provided with an opening and then flexibly disposed to the bearing bracket 24. The ear piece 23 is a plate-like body with a curl facing inwards, and has an upper end thereof formed as a blunt extruding surface 26 and the foregoing idle pulley 25 located at a lower end thereof. The idle pulley 25 is in surface contact with the corresponding protruding wheel 17, and is secured by an orifice or a tapped hole 27 at the ear piece 23 and a screw 28. A roller 29 is provided at a rear end of the screw 28 to facilitate contact with the protruding wheel 17. For traction, between the two extrusion mechanisms 21 and 22 are respectively provided with springs 30 and 31, which can be fixed to either the ear piece 23 or the bearing bracket 24. Referring to FIGS. 5 and 6, each of the ear pieces 23 near the blunt extruding surface 26 may be similarly provided with an idle pulley 32 as the idle pulley 25 at the lower end of the ear piece 23. More specifically, the ear piece 23 is provided with a tapped hole 33 for securing the idle pulley 32 with a roller 34. It is to be noted that the idle pulleys 25 and 32 are flexibly secured, the rollers are allowed to spin freely for reducing contact friction. Since the extrusion is accomplished through the idle pulley 32 that provides a contact surface formed by rolling movements, the soft hopper in contact remains undamaged. The blunt extruding surface 26 and the idle pulley 32 facilitate the extrusion performed by the soft hopper 35 provided below the opening 2. With reference to FIGS. 2, 4 and 12, the soft hopper 35, being a soft material made easy for extrusion, comprises a material recess 36, a supporting frame 37 in a projecting manner at upper edges thereof, a plurality of orifices 38, a surrounding wall 39 extended downwards from the inwards of the supporting frame 37, two sloped walls 40 and 41 stretched from the surrounding wall 39 to meet and to be connected at a round groove 42 at a same side as the physical pin 12, a vertical wall 45 formed downwards from the other side of the surrounding wall 39 to connect with the round groove as a dispensing end, and two attaching loop covers 46 and 47 respectively at front and rear ends of the round groove 42. Accordingly, a middle lower section of the round groove 42 is form of a recess while two ends thereof are in form of openings. A space contained by the round groove 42 and the two loop covers 46 and 47 is sufficient for accommodating the pusher screw pole 9, which can also have two ends thereof enveloped by the power shaft 7 with a rear end thereof aligned with an outer end of the base housing 1. The four ear pieces 23 of the extrusion mechanisms 21 and 22 are exactly located at positions forming a rhomboid when a cross section of the material recess 36 is viewed from the top. Further, the base housing 1 is provided with a hollow sleeve 48 at an outer side of the orifice 6 for dispensing the material, and a material bucket 49 is provided at an upper end of the opening 2 of the base housing 1 for accommodating the raw material to be fallen from a rear end thereof. The material bucket 49 comprises an orifice 50 for securing with the orifice 38 of the soft hopper 35 and the orifice 3 of the base housing 1 with a screw (not shown) to accomplish an entire feeder system.

Figure 7:
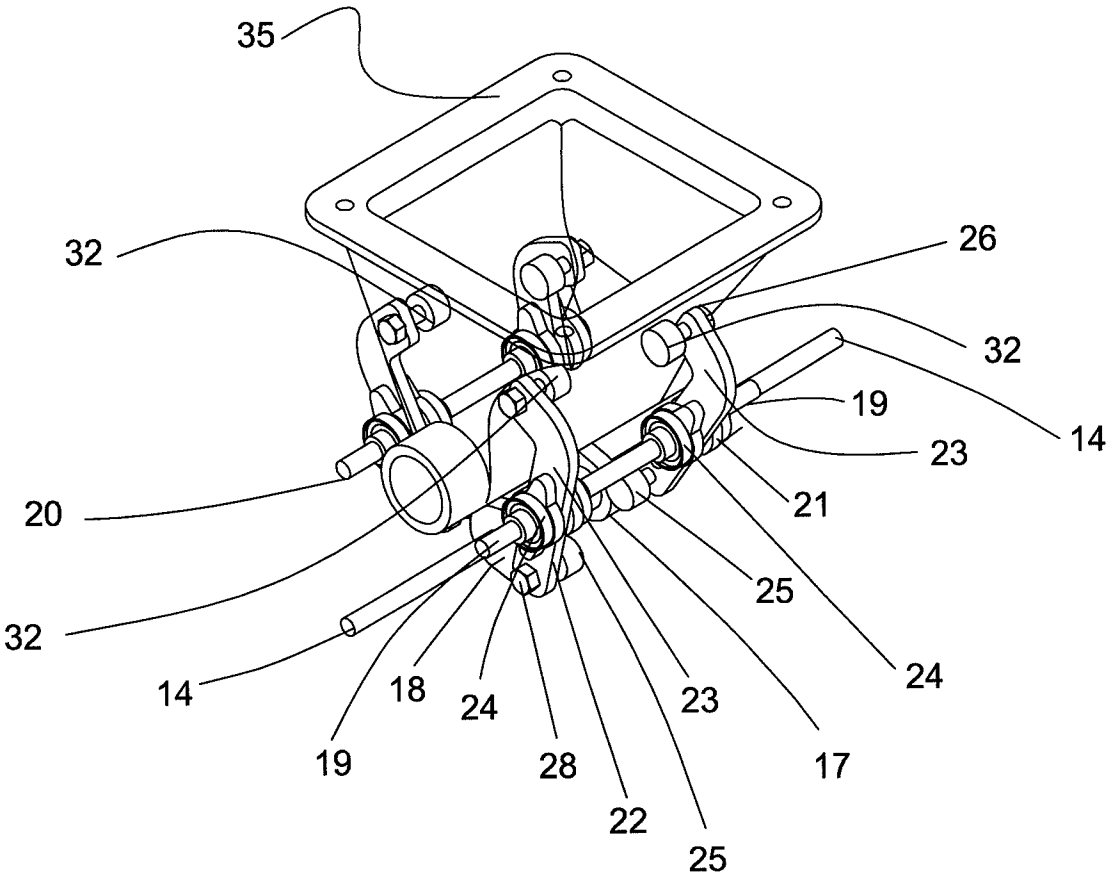
FIG. 7 is a schematic diagram illustrating extrusion performed by a variable rhomboidal wall formed by extrusion mechanisms of the present invention.
Figure 8:
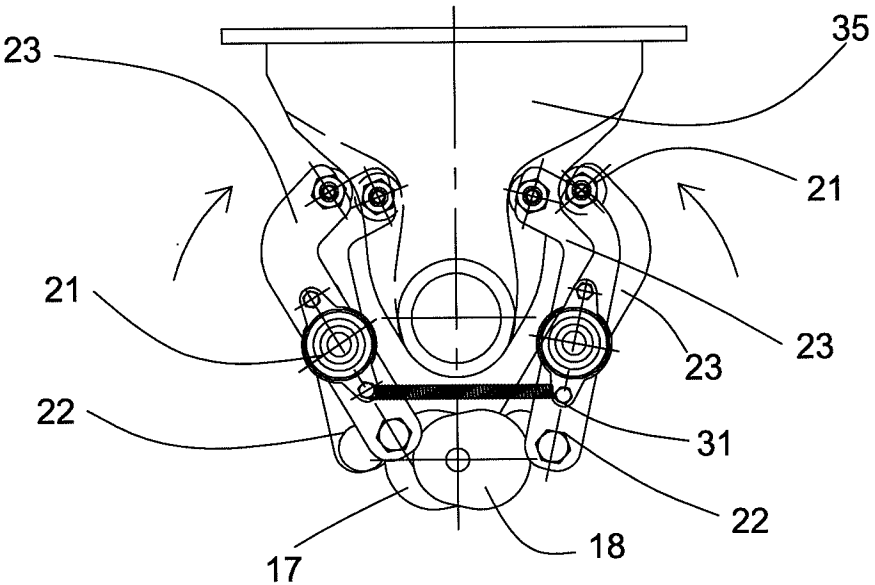
FIG. 8 is a front view of a variable rhomboidal wall formed by extrusion mechanisms of the present invention.
Figure 9:
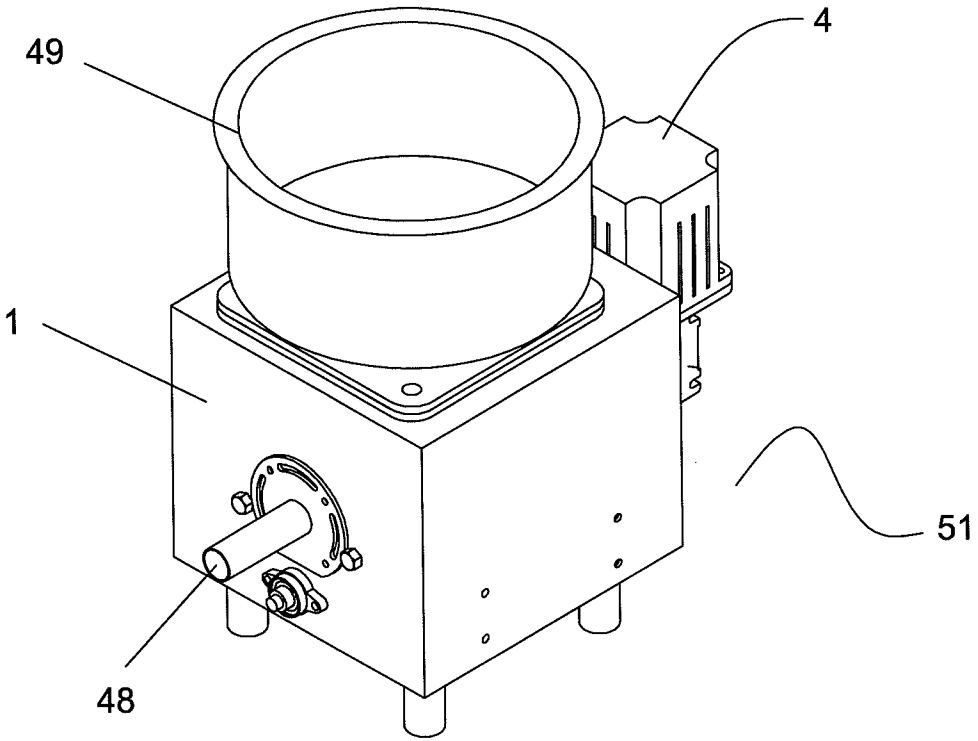
FIG. 9 is a three-dimensional view of the present invention.

Referring to FIG. 9, in the rhomboidal wall feeder 51 as described, the structure of the soft hopper 35 facilitate the raw material to smoothly fall into the material recess 36. When the motor 4 is activated to operate the decelerator 5 along with the four ear pieces 23 of the extrusion mechanisms 21 and 22, two diagonal out of the four ear pieces 23 alternately extrude inwardly in arched movements in pairs, i.e., a pair squeeze while the other pair retreats (as shown in FIGS. 7 and 8), so that the material in the material recess 36, not only affected by cutting forces but also larger space differences caused by forces from the drastic shape change of the rhomboid, is allowed to smoothly fall below to be forwarded by the pusher material pole 9 for further processing. More specifically, the rhomboid shape change is also referred to as the variable rhomboidal wall, which eliminates any heaping issues of the raw material by completely destructing the bridge effect.

For example, to secure a vibrator or other devices for enhancing machinery operations, supporting walls 52 are provided to two sides of the base housing 1.

Figure 10:
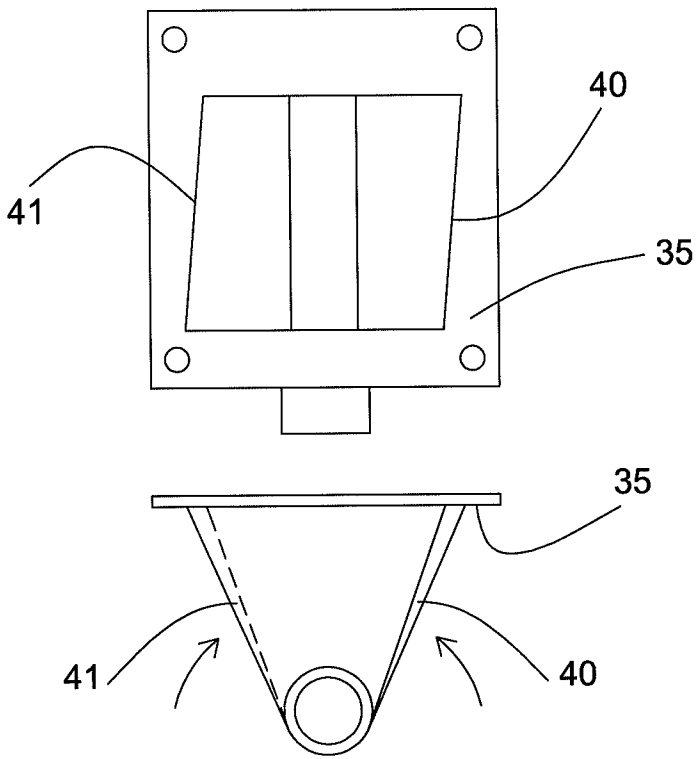
FIG. 10 is a schematic diagram illustrating a first movement of a variable rhomboidal wall when the present invention is provided with long plates.
Figure 11:
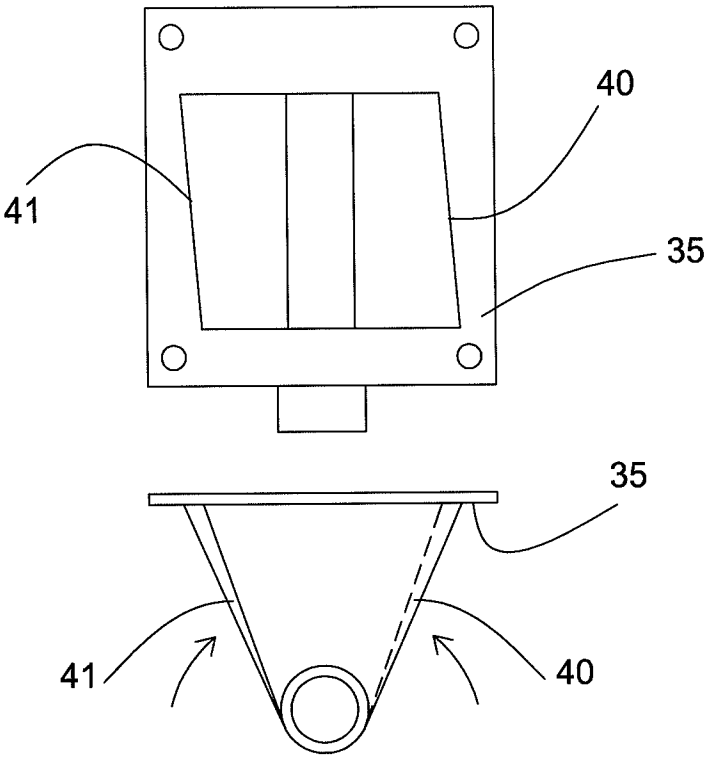
FIG. 11 is a schematic diagram illustrating a second movement of a variable rhomboidal wall when the present invention is provided with long plates.

For example, referring to FIGS. 10, 11 and 12, two one-piece long plates 53 are provided at appropriate internal positions of the sloped walls 40 and 41, so as to provide even greater area changes during extrusion performed by the extrusion mechanisms 21 and 22 to yield an even greater variable rhomboidal wall effect.

While the invention has been described in terms of what is presently considered to be the most practical and preferred embodiments, it is to be understood that the invention needs not to be limited to the above embodiments. On the contrary, it is intended to cover various modifications and similar arrangements included within the spirit and scope of the appended claims which are to be accorded with the broadest interpretation so as to encompass all such modifications and similar structures.

It is of course to be understood that the embodiments described herein is merely illustrative of the principles of the invention and that a wide variety of modifications thereto may be effected by persons skilled in the art without departing from the spirit and scope of the invention as set forth in the following claims.

What is claimed is:

1. A feeder with variable rhomboidal walls, comprising:

a quadrilateral base housing, comprising an accommodating space, an opening at an upper end thereof, an orifice, a motor joined with a decelerator, and an orifice at another side thereof; wherein, the orifice at the another side is fixed with a hollow sleeve, the decelerator is provided with a power shaft, which is provided with a power shaft gear and an indenture at a front end thereof for accommodating a pusher screw pole therein;

a soft hopper, located below the opening, having an accommodating space for accommodating the pusher screw pole;

a material barrel, located above the opening, having an accommodating space;

a horizontal bar, located in the base housing, being flexibly disposed by two bearing brackets at two sides of the base housing, provided with a horizontal bar gear at a front end thereof, two corresponding protruding wheels at a middle section thereof, the horizontal bar gear engaging the power shaft gear;

two supporting rods, respectively located at two sides of the horizontal bar, respectively provided with a pair of extrusion mechanisms at an appropriate position at front and rear ends thereof, being in contact with the two protruding wheels; and two springs respectively hooked to the two pairs of the extrusion mechanisms;

wherein, the extrusion mechanisms outline rhomboids when performing extrusion with respect to the soft hopper, so as to eliminate a bridge effect as well as smoothly dispensing a raw material.

2. The feeder with variable rhomboidal walls as claimed in claim 1, wherein the soft hopper comprises a material recess, a supporting frame in a projecting manner at upper edges thereof, a plurality of orifices, a surrounding wall extended downwards from the inwards of the supporting frame, two sloped walls stretched from two sides of the surrounding wall, a vertical wall formed downwards with a slope from a rear side of the surrounding wall, a vertical wall formed downwards with a slope from a front side of the surrounding wall to a middle part of the material recess, a vertical wall formed downwards with a slope, a round groove where all four walls meet, and two protruding loop covers at front and rear ends of the round groove.

3. The feeder with variable rhomboidal walls as claimed in claim 1, wherein the pusher screw pole comprises a screw and a physical pin, and the physical pin is welded to and enveloped by the screw.

4. The feeder with variable rhomboidal walls as claimed in claim 1, wherein each of the extrusion mechanisms comprises at least ear pieces, a bearing bracket, and an idle pulley; each of the ear pieces is fixed to the supporting rod via the bearing bracket, and is capable of one-axial movements; and the idle pulleys at upper and lower ends of the ear piece are flexibly secured to rollers by a tapped hole at the ear piece and a screw.

5. The feeder with variable rhomboidal walls as claimed in claim 1, wherein two inner sides of the base housing are provided with supporting plates.

6. The feeder with variable rhomboidal walls as claimed in claim 1, wherein the soft hopper comprises a long plate at the sloped walls thereof, so as to obtain optimal effects of the variable rhomboidal walls.

* * * * *